US006736858B2

(12) United States Patent
Kita et al.

(10) Patent No.: US 6,736,858 B2
(45) Date of Patent: May 18, 2004

(54) AGENT FOR IMPARTING DURABLE LIQUID PERMEABILITY AND FIBER APPLIED THEREWITH

(75) Inventors: Setuo Kita, Yao (JP); Haruhiko Komeda, Yao (JP); Yoshishige Nakamura, Yao (JP)

(73) Assignee: Matsumoto Yushi-Seiyaku Co., Ltd., Osaka (JP)

( * ) Notice: Subject to any disclaimer, the term of this patent is extended or adjusted under 35 U.S.C. 154(b) by 203 days.

(21) Appl. No.: 09/986,948

(22) Filed: Nov. 13, 2001

(65) Prior Publication Data

US 2002/0104168 A1 Aug. 8, 2002

(30) Foreign Application Priority Data

Nov. 22, 2000 (JP) ..... 2000-399353

(51) Int. Cl.[7] ..... D06M 13/224; D06M 13/288; D06M 13/328

(52) U.S. Cl. ..... 8/115.61; 8/115.54; 8/115.56; 8/115.64; 8/115.65

(58) Field of Search ..... 8/115.54, 115.56, 8/115.61, 115.64, 115.65

(56) References Cited

FOREIGN PATENT DOCUMENTS

| | | |
|---|---|---|
| JP | 60-215870 | 10/1985 |
| JP | 63-14081 | 3/1988 |
| JP | 3-82871 | 4/1991 |
| JP | 4-82961 | 3/1992 |
| JP | 2000-170076 | 6/2000 |
| WO | WO 99/18279 | 4/1999 |

*Primary Examiner*—Margaret Einsmann
(74) *Attorney, Agent, or Firm*—Sherman & Shalloway

(57) ABSTRACT

The present invention provides fiber and fiber products for topsheet of diapers and sanitary napkins having superior surface properties attained by a fiber-treating agent. The surface properties attained by the fiber-treating agent include decreased wet-back of excreted liquid through topsheet, which has been attained by modifying the structure of disposable diapers or sanitary napkins, improved durable hydrophilicity of topsheet and minimized time-dependent reduction of the durable hydrophilicity of topsheet. The present invention also provides a fiber treating agent for imparting liquid permeability to fiber, consisting of (a) 20 to 60 weight percent of alkyl phosphate salts, (b) 10 to 30 weight percent of a trialkylglycine derivative, (c) 5 to 20 weight percent of polyoxyalkylene-modified silicone and (d) 10 to 35 weight percent of an ester of dicarboxylic acid and alkoxylated ricinolein and/or hydrogenated product thereof, wherein at least one of hydroxyl groups is esterified with saturated and/or unsaturated monocarboxylic acid.

4 Claims, No Drawings

AGENT FOR IMPARTING DURABLE LIQUID PERMEABILITY AND FIBER APPLIED THEREWITH

BACKGROUND OF THE INVENTION

The present invention relates to a fiber-treating agent suitable for fiber to be processed into nonwoven topsheet of diapers and sanitary napkins and the fiber and fiber product applied with the agent. More precisely, the present invention provides a fiber-treating agent, which minimizes "wet-back", i.e., the wetting of a wearer's skin caused from the backflow of excreted liquid (urine, etc.) through topsheet after the liquid is absorbed in a diaper or sanitary napkin, and improves the liquid permeability and the durable hydrophilicity of the topsheet of diapers and sanitary napkins; and fiber and fiber products treated with the agent.

Absorbent products, such as diapers or sanitary napkins, consist of nonwoven topsheet, which is made of polyester fibers as major material and of triacetate fiber or hydrophobic polyolefin fiber being included partially and imparted with hydrophilicity; water-repellent back sheet; and absorbent of fibriform pulp or absorbent polymer placed between the topsheet and back sheet. When excreted liquid (urea etc.) is absorbed into absorbent through topsheet, topsheet is expected to pass the liquid with excellent liquid permeability that shorten the absorption time of the liquid into absorbent without leaving wet touch on topsheet surface, and is also expected to prevent the absorbed liquid from backflow out of the topsheet surface. In addition, the fiber treating agent is required to impart durable hydrophilicity to topsheet without flowing off from topsheet surface after a few times of excretion passing and reducing the water permeability of topsheet for the purpose of minimizing the frequency of diaper exchange and keeping the surface property of topsheet against time-dependent deterioration.

For smooth nonwoven processing, the fiber applied with the treating agent must have satisfactory antistaticity that prevents fiber from wrapping on cylinders in carding and contributes to uniform web forming.

Comfortable diapers must have topsheet that has superior liquid permeability with minimum wet-back and durable hydrophilicity that keeps the liquid permeability of the topsheet after repeated liquid passing through the topsheet. Several techniques and treating agents have already been suggested for improving those properties. A method for treating fiber with $C_{12-22}$ linear potassium alkyl phosphate is disclosed in Japanese Patent Publication 63-14081, a fiber-treating agent formulated by blending $C_{10-30}$ alkyl phosphate salt with $C_{10-30}$ betaines, sulfates or sulfonates is disclosed in Japanese Patent Laid-Open 60-215870, a technique utilizing a blend of alkyl phosphate salt and polyether-modified silicone is disclosed in Japanese Patent Laid-Open 4-82961, and a technique utilizing a blend of alkyl phosphate salt and two betaines is disclosed in Japanese Patent Laid-Open 2000-170076. Further a fiber-treating agent of alkoxylated ricinolein or hydrogenated product thereof, an agent being different from the above-mentioned agents, is disclosed in Japanese Patent Laid-Open 3-82871.

All of the treating agents mentioned above cannot sufficiently prevent the wet-back of absorbed liquid though they impart desirable surface properties to nonwoven topsheet to some extent. Hydrophilic agents are preferable for improving liquid permeability of topsheet while hydrophobic agents are preferable for minimizing wet-back. However, improved liquid permeability and minimized wet-back not only depend on the hydrophilic and hydrophobic components of fiber treating agents but also depend on other factors such as chemical structure of the components of agents, ratio between hydrophilic and hydrophobic components and the interaction between those components. In the conventional processes, wet-back has been minimized by modifying the structure of diapers or sanitary napkins, e.g., forming double layer topsheet of two nonwoven variants having different hydrophilic properties or controlling the layout and quantity of fibriform pulp or absorbent polymer, because it has been difficult to attain both of improved liquid permeability and minimized wet-back only with fiber-treating agents.

SUMMARY OF THE INVENTION

The present invention aims to provide a fiber treating agent for minimizing wet-back, which has been attained by modifying the structure of diapers and sanitary napkins, improving the durable hydrophilicity of topsheet and minimizing the time-dependent reduction of the hydrophilicity and to provide fiber and fiber products having excellent properties on their surface.

DETAILED DISCRIPTION OF THE INVENTION

The aim of the present invention can be attained by a fiber treating agent for imparting liquid permeability, which comprises (a) 20 to 60 weight percent of alkyl phosphate salts, (b) 10 to 30 weight percent of a trialkylglycine derivative, (c) 5 to 20 weight percent of a polyoxyalkylene-modified silicone and (d) 10 to 35 weight percent of an ester consisting of dicarboxylic acid and alkoxylated ricinolein and/or hydrogenated product thereof, in which at least one of hydroxyl groups is esterified with saturated and/or unsaturated monocarboxylic acid.

The preferable alkyl phosphate salts for the present invention are those having $C_{6-18}$ alkyl groups, more preferably those having $C_{8-14}$ alkyl groups. Phosphates of which alkyl groups have more than 18 carbon atoms reduce hydrophilicity of fiber applied with resultant fiber-treating agent and those of which alkyl groups have less than 6 carbon atoms decrease lubricity of fiber applied with resultant fiber-treating agent. Applicable bases for forming the said phosphates are alkali metals and amines, and alkali metals are preferable. The preferable ratio of the said alkyl phosphate salts in the fiber-treating agent of the present invention is 20 to 60 weight percent, more preferably 25 to 55 weight percent. The ratio greater than 60 weight percent will reduce the durable hydrophilicity of the resultant nonwoven fabric while the ratio less than 20 weight percent will give adverse effect to the processability of the resultant fiber in carding.

A polyoxyalkylene alkyl phosphate salt, which is a polyoxyalkylene adduct of the said alkyl phosphate salts, can be blended to the said alkyl phosphate salts for supplementing the hydrophilicity of the resultant fiber. The preferable ratio of such polyoxyalkylene alkyl phosphate salt is 10 to 30 weight percent of the said alkyl phosphate salts.

The said trialkylglycine derivative contains so-called betaine structure, i.e., the internal salt consisting of a carboxyl group and a quaternary ammonium of a nitrogen atom in a glycine molecule to which three alkyl groups are bonded. The alkyl groups can be selected among those having 1 to 22 carbon atoms. The examples of the said trialkylglycine derivatives are dimethyldodecylglycine hydroxide, dimethyltetradecylglycine hydroxide, dimethyloctadecylglycine hydroxide, heptadecylimidazoliumhydroxyethylglycine hydroxide and β-hydroxyoctadecyldimethylglycine hydroxide. Among those mentioned above, the glycine derivatives of which three alkyl groups consist of two lower alkyl groups such as methyl and ethyl groups and one long-chain alkyl group having 12 or more carbon atoms are preferable. And most preferable are dimethyloctadecylglycine hydroxide and heptadecylimidazoliumhydroxyethylglycine hydroxide. The preferable ratio of the said trialkylglycine derivatives is 10 to 30 weight percent. The ratio lower than 10 weight percent cannot attain satisfactory durable hydrophilicity of resultant nonwoven topsheet and the ratio higher than 30 weight percent will result in increased wet-back and reduced dry touch of topsheet though higher ratio contributes to more durable hydrophilicity of topsheet.

The preferable polyoxylalkylene-modified silicones are those described in the general formula shown below:

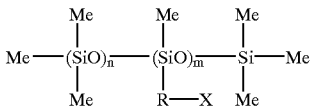

wherein Me is a methyl group, R is a methylene, propylene, N-(aminoethyl) methylimino or N-(aminopropyl) propylimino, X is a polyoxyalkylene group, and n and m are the figures selected among those with which the ratio of silicon is controlled from 20 to 70 weight percent in the molecule and the molecular weight of the resultant silicone is controlled from 1000 to 100,000.

The content of silicon in the said polyoxylalkylene-modified silicone must be controlled from 20 to 70 weight percent, because a content of more than 70 weight percent will produce unstable product and require higher production cost and a content of less than 20 weight percent cannot attain sufficient hydrophilicity of fiber and topsheet. The examples of the polyoxyalkylene groups in the said polyoxylalkylene-modified silicone are polyoxyethylene group, polyoxypropylene group, polyoxybutylene group and the copolymers thereof. The polyoxyalkylene groups of the said modified silicone must contain 20 weight percent or more of polyoxyethylene group because a polyoxyalkylene groups containing less than 20 weight percent of polyoxyethylene group cannot attain sufficient hydrophilicity of fiber and topsheet. And the molecular weight of the said polyoxyalkylene-modified silicone must be controlled from 1,000 to 100,000, because a polyoxyalkylene-modified silicone having a molecular weight beyond the range results in insufficient hydrophilicity of fiber and topsheet, especially a polyoxyalkylene-modified silicone having a molecular weight below 1,000 results in remarkably poor hydrophilicity of fiber and topsheet. The preferable ratio of the said polyoxyalkylene-modified silicone to the said fiber-treating agent is 5 to 20 weight percent, more preferably 5 to 15 weight percent. A fiber treating agent containing more than 20 weight percent of the said polyoxyalkylene-modified silicone results in increased wet-back, contrary to the aim of the present invention, and increased snow deposit in fiber production and nonwoven processing, though such agent can impart durable hydrophilicity to fiber and topsheet. A fiber-treating agent containing less than 5 weight percent of the said polyoxyalkylene-modified silicone cannot attain sufficiently durable hydrophilicity of fiber and topsheet.

The alkoxylated ricinolein and its hydrogenated product contained in the ester of dicarboxylic acid and alkoxylated ricinolein and/or hydrogenated product thereof, wherein at least one of the hydroxyl groups is esterified with saturated and/or unsaturated monocarboxylic acid, of the present invention is an alkylene oxide adduct of the ester of polyhydric alcohol and hydroxymonocarboxylic acid. The examples of the polyhydric alcohols are ethylene glycol, glycerin, sorbitane and trimethylol propane, and one or more of them can be employed while glycerin is preferable. The examples of the hydroxy monocarboxylic acids are glycol acid, lactic acid, ricinoleic acid, 12-hydroxystearic acid and salicylic acid, and one or more of them can be employed while ricinoleic acid and 12-hydroxystearic acid are preferable.

The examples of the said alkylene oxides are those having 2 to 4 carbon atoms such as ethylene oxide, propylene oxide and butylene oxide, and one or more of them can be employed. The preferable mole number of alkylene oxide to be added to the said ester of polyhydric alcohol and hydroxymonocarboxylic acid is usually from 5 to 150, preferably 10 to 80, to one mole of the said ester, in other words, 0 to 80, preferably from 5 to 30, to one hydoxyl group of the said ester.

The mole percent of ethylene oxide out of the said alkylene oxide to be added to the said ester is 50 mole percent or more, preferably 80 mole percent or more. The alkylene oxide adduct of the said ester of polyhydric alcohol and hydroxy monocarboxylic acid can be produced through the esterification of polyhydric alcohol and hydroxy monocarboxylic acid under normal condition followed by the addition reaction of alkylene oxide. Natural oils such as castor oil, and hydrogenated castor oil produced by hydrolyzing castor oil can preferably be employed for the esterification.

The dicarboxylic acid employed for producing the ester of dicarboxylic acid and alkoxylated ricinolein and/or hydrogenated product thereof is one or more of the acids selected from the group comprising oxydipropionic acid, dipropionic acid, succinic acid, maleic acid, sebacic acid and phthalic acid. In addition, 20 percent or less, preferably 10 percent or less of one or more of lauric acid, oleic acid, stearic acid, behenic acid and benzoic acid can be contained in the dicarboxylic acid for the said ester. The mole ratio for the reaction of the said alkyleneoxide adduct of the ester of polyhydric alcohol and hydroxymonocarboxylic acid and the said dicarboxylic acid is usually 1.0:1.0 to 2.0:1.0, preferably 1.5:1.0 to 2.0:1.0. The esterification can be carried out under normal condition.

The ester of the present invention consisting of dicarboxylic acid and alkoxylated ricinolein and/or hydrogenated product thereof, wherein at least one of its hydroxyl groups is esterified with saturated and/or unsaturated monocarboxylic acid, can be produced by esterifying the above-mentioned ester of the dicarboxylic acid and the alkylene oxide adduct of the ester of the polyhydric alcohol and hydroxymonocarboxylic acid with saturated and/or unsaturated monocarboxylic acid under normal condition. The monocarboxylic acid employed for the esterification is one or more of those selected from the group comprising lauric acid, myristic acid, palmitic acid, arachic acid, stearic acid, oleic acid, behenic acid and benzoic acid. The ester of the alkylene oxide adduct and the dicarboxylic acid is reacted with the monocarboxylic acid in the mole ratio of 1.0:0.2 to 1.0:1.0, preferably 1.0:0.4 to 1.0:0.8, under normal condition.

The preferable blend ratio of the ester of dicarboxylic acid and alkoxylated ricinolein and/or hydrogenated product thereof, wherein at least one of the hydroxyl groups is esterified with saturated and/or unsaturated monocarboxylic acid in the fiber-treating agent of the present invention is 10 to 35 weight percent. The ratio less than 10 weight percent cannot attain sufficiently durable hydrophilicity to fiber while the ratio more than 35 weight percent results in poor carding performance of the resultant fiber.

Antistatic agents, such as sodium alkane sulfonate, emulsifiers such as amphoteric n-alkylsulfopyrrolidone or nonionic surfactants and lubricants such as carnauba wax can be optionally added to the fiber-treating agent, which imparts durable liquid permeability, of the present invention. Antifoams and antiseptics can also be added if necessary.

The fiber treating agent for imparting durable liquid permeability of the present invention is suitable to be applied to hydrophobic fibers, their products, fibrillated polyolefin fiber, and thermally bondable composite fibers having sheath-core structure such as polyester-polyethylene fiber, polyester-polypropylene fiber, copolypropylene-polyropylene fiber, copolyester-polypropylene fiber and copolyester-copolyester fiber.

The fiber-treating agent for imparting durable liquid permeability of the present invention can be applied to various thermally bondable fibers, not only to polyolefin fiber and fibrillated polyolefin fiber but also to polyester fiber, nylon fiber, polyvinyl fiber and composite fiber thereof. The agent can be applied to nonwoven fabrics including spun-bonded nonwoven, span-laced nonwoven or melt-blown nonwoven fabric. The textile products to which the fiber treating agent of the present invention is applicable include not only the end products of fiber, i.e., clothing such as underwear, but also web and nonwoven fabric processed of thermally bondable fibers and the blends thereof.

The fiber-treating agent for imparting durable liquid permeability of the present invention can be applied to fiber from aqueous emulsion or dilution in solvent. The aqueous emulsion prepared by dissolving the agent in 5 to 30-weight percent concentration in water or the dilution in solvent prepared by diluting the agent in 5 to 30-weight percent concentration in a low-viscosity hydrocarbon is applied to fiber or added to polymer in fiber production process to the ratio mentioned below. Either rolls or spray can be employed for applying the agent to fiber.

The fiber-treating agent for imparting durable liquid permeability of the present invention is usually applied to fiber in 0.1 to 2.0 weight percent, preferably in 0.3 to 0.7 weight percent of fiber. The agent applied less than 0.1 weight percent of fiber cannot attain sufficient and durable liquid permeability. And the agent applied more than 2 weight percent of fiber results in increased fiber wrapping in carding that seriously decreases fiber processing efficiency, and increases the stickiness on the surface of fiber products such as nonwoven fabric after liquid passing through it.

The preferable ratio for adding to fiber polymer is 2 to 30 weight percent, more preferably 3 to 15 weight percent. A ratio less than 2 weight percent results in insufficient liquid permeability while a ratio more than 30 weight percent causes decreased fiber tenacity that seriously decreases fiber processing efficiency.

Application of the fiber-treating agent for imparting durable liquid permeability of the present invention to fiber and fiber products will decrease backflow of excreted liquid (urine, etc.) and will remarkably minimize the time-dependent reduction of the durable liquid permeability against repeated liquid passing (time-dependent reduction of the durable hydrophilicity of fiber). Simultaneously the fiber-treating agent improves antistaticity and lubricity of fiber, which improve fiber-opening behavior and processability of fiber in carding in nonwoven production process.

The present invention will further described with the following examples, though the present invention is not restricted within the scope of those examples.

EXAMPLES AND COMPARATIVE EXAMPLES

The formulae of the agents of the Examples and Comparative Examples are summarized in Tables 1 and 2. The ratios of the components of those agents are represented by weight percent. The tested properties and performances and the testing procedure are as in the following.

TABLE 1

| Components | | | | Ex. 1 | Ex. 2 | Ex. 3 | Ex. 4 | Ex. 5 | Ex. 6 | Ex. 7 |
|---|---|---|---|---|---|---|---|---|---|---|
| a | | | | 40 | 60 | 40 | 40 | 60 | 25 | 35 |
| b | | | | | | 10 | | | | 5 |
| c | | | | 10 | 10 | 20 | 20 | 20 | 30 | 30 |
| e | | | | 30 | 20 | 20 | 35 | 10 | 35 | 25 |
| d | Silicon ratio | EO ratio | M.W. | | | | | | | |
| | 15 | 50 | 2,000 | | | | | | | |
| | 35 | 60 | 7,000 | | | | | 10 | 10 | |
| | 65 | 100 | 10,000 | 20 | 10 | 10 | 5 | | | |
| | 70 | 80 | 55,000 | | | | | | | 5 |

Ex.: Example
EO: ethylene oxide
M.W.: molecular weight
Component a: potassium lauryl phosphate
Component b: sodium polyoxyethylene (3) lauryl ether phosphate
Component c: dimethyloctadecylglycine hydroxide
Component d: polyoxyethylene/polyoxypropylene-modified silicone
Component e: an ester produced by esterifying the ester of polyoxyethylene (20) castor wax and maleic acid being esterified in 2:1 mol ratio, and stearic acid, in 2:1 mol ratio

TABLE 2

| Components | Comp. ex. 1 | Comp. ex. 2 | Comp. ex. 3 | Comp. ex. 4 | Comp. ex. 5 | Comp. ex. 6 | Comp. ex. 7 |
|---|---|---|---|---|---|---|---|
| a | 70 | 40 | 50 | 50 | 60 | 15 | 40 |
| b | | 10 | | | 15 | | |

TABLE 2-continued

| Components | | | | Comp. ex. 1 | Comp. ex. 2 | Comp. ex. 3 | Comp. ex. 4 | Comp. ex. 5 | Comp. ex. 6 | Comp. ex. 7 |
|---|---|---|---|---|---|---|---|---|---|---|
| c | | | | 10 | 30 | 5 | 30 | 10 | 30 | 20 |
| e | | | | 15 | 10 | 30 | 20 | 5 | 35 | 10 |
| d | Silicon ratio | EO ratio | M.W. | | | | | | | |
| | 15 | 50 | 2,000 | | 10 | | | | | |
| | 35 | 60 | 7,000 | | | | | 10 | | 30 |
| | 65 | 100 | 10,000 | 5 | | 15 | | | 20 | |
| | 70 | 80 | 55,000 | | | | | | | |

Ex.: Example
EO: ethylene oxide
M.W.: molecular weight
Component a: potassium lauryl phosphate
Component b: sodium polyoxyethylene (3) lauryl ether phosphate
Component c: dimethyloctadecylglycine hydroxide
Component d: polyoxyethylene/polyoxypropylene-modified silicone Component e: an ester produced by esterifying the ester of polyoxyethylene (20) castor wax and maleic acid being esterified in 2:1 mol ratio, and stearic acid, in 2:1 mol ratio Each of the agents of the Examples and Comparative Examples was diluted, and the dilution was applied to each portion of a fiber by 5 owf (abbreviated from "on the weight of fiber"), in other words, the active content of each of the agents was applied to fiber by 0.5 weight percent, and the portions were dried. Then the portions were processed in beating and carding to be formed into web samples having a density of 30 g/m$^2$. The web samples were heated at 130° C. in an air-through oven to be fixed and finished into nonwoven fabric samples. The hydrophilicity of the resultant nonwoven fabric samples was tested as follows.

Carding performance: The carding performance, i.e., the processability of the fiber portions in carding was determined by inspecting fiber wrapping on the carding cylinder after carding at 30° C. and 70% RH. The antistaticity of the fiber portions was determined by checking static charge on fiber during the carding operation at 20° C. and 45% RH. Each of the performances was ranked as follows.

Wrap on cylinder: After carding 40 g of a fiber portion with a carding tester at 30° C. and 70% RH, the cylinder of the tester was inspected. The fiber wrapping on the cylinder of the carding tester was graded as follows. 5: no fiber wrapping, 4: fiber wrapping on 1/10 of cylinder surface, 3: fiber wrapping on 1/5 of cylinder surface, 2: fiber wrapping on 1/3 of cylinder surface, 1: fiber wrapping on the whole of cylinder surface. The grade 5 is the most preferable.

Antistaticity: A web of 40 g of a fiber portion was processed with a carding tester at 20° C. and 45%RH. And the static charge on the web was checked and graded as follows. A fiber portion resulting in less than 100 v of static charge on its web can be fed to actual process. 5: below 100 V, 4: 0.1 to 1.0 kV, 3: 1.0 to 1.5 kV, 2: 1.5 to 2.0 kV, 1: greater than 2.0 kV. The grade 5 is the most preferable.

Wet-back: A nonwoven sample cut into a square with side-length 10 cm was placed on a diaper available in market and a pipe with 60 mm inner diameter was placed on the nonwoven sample. A physiological salt solution (100 ml) was poured into the pipe to be absorbed into the nonwoven sample. After the nonwoven sample absorbed the whole of the solution, the pipe was removed and twenty sheets of filter paper (No.5, TOYO ROSHI) of which weight had been measured previously were laid onto the surface of the nonwoven sample. Then 5-kg loading was placed on the laid filter paper. After 5 minutes, the twenty sheets of filter paper were reweighed to check the increase of their weight in grams that represented the quantity of the wet-back of the solution. The quantity of 1 g or less is preferable though the acceptable limit is 1.5 g.

Initial hydrophilicity of nonwoven fabric: A nonwoven fabric sample of 30-g/m$^2$ density was laid on filter paper (No.5, TOYO ROSHI) and one drop (approx. 0.05 ml) of a physiological salt solution was dropped onto the nonwoven fabric sample from a burette set 10 mm above the nonwoven fabric sample. The time required for the drop being absorbed and disappeared from the surface of the nonwoven fabric sample was checked. Each of twenty drops was dropped on different point of the nonwoven fabric sample and the drops disappeared within five seconds were counted. A nonwoven sample absorbing each of 18 or more drops within five seconds was evaluated to have satisfactory initial hydrophilicity.

Durable hydrophilicity of nonwoven fabric: The nonwoven fabric sample (cut into a square with side-length 10 cm) tested in the above wet-back test was laid on a diaper available in market and a pipe with 60 mm inner diameter was placed on the nonwoven fabric sample. A physiological salt solution (80 ml) was poured into the pipe to be absorbed into the diaper through the nonwoven fabric sample. After 3 minutes, the nonwoven fabric sample was laid between two sheets of filter paper (No.5, TOYO ROSHI), and a board cut into a square with side-length 10 cm and a loading (of which weight were totaled into 3.5 kg) were placed on the laid nonwoven fabric sample and filter paper for dehydrating the nonwoven fabric sample for 3 minutes. Then the nonwoven fabric sample was dried at normal temperature for 5 minutes. After drying, the area of the nonwoven fabric sample where the physiological salt solution passed was tested in the initial hydrophilicity test and the drops disappeared within 5 seconds were counted out of 20 drops placed on different points. The nonwoven fabric sample having the area where 18 or more drops disappeared within 5 seconds was evaluated to have satisfactory initial hydrophilicity. The above procedure of durable hydrophilicity testing was repeated. A nonwoven fabric sample on which more drops of the physiological salt solution disappeared throughout the repeated testing was evaluated to maintain superior durable hydrophilicity.

Time-dependent reduction of durable hydrophilicity: The nonwoven fabric sample (cut into a square with side-length 10 cm) tested in the above durable hydrophilicity testing was placed in an incubator conditioned at 40° C. and 70% RH for 30 days. Then the sample was taken out of the incubator and its initial hydrophilicity and durable hydrophilicity were tested. A nonwoven fabric sample showing less difference between those hydrophilic properties before and after being placed in an incubator was evaluated to keep better durable hydrophilicity against time-dependent change.

The results of the above testing of the agents in Examples and Comparative Examples are summarized in Tables 3 and 4.

TABLE 3

| | | Ex. 1 | Ex. 2 | Ex. 3 | Ex. 4 | Ex. 5 | Ex. 6 | Ex. 7 |
|---|---|---|---|---|---|---|---|---|
| Carding performance Wrap on cylinder | | 5 | 5 | 5 | 5 | 5 | 5 | 5 |
| Antistaticity | | 5 | 5 | 5 | 5 | 5 | 5 | 5 |
| Hydrophilicity of nonwoven | | | | | | | | |
| Initial hydrophilicity | | 20 | 20 | 20 | 20 | 20 | 20 | 20 |
| Durable hydrophilicity | 1st | 20 | 20 | 20 | 20 | 20 | 20 | 20 |
| | 2nd | 20 | 20 | 20 | 20 | 20 | 20 | 20 |
| | 3rd | 14 | 16 | 16 | 15 | 16 | 17 | 16 |
| | 4th | 9 | 6 | 10 | 8 | 9 | 11 | 10 |
| | 5th | 4 | 1 | 6 | 2 | 3 | 6 | 5 |
| Wet-back (g) | | 1.0 | 0.9 | 0.8 | 1.0 | 1.0 | 1.2 | 1.3 |
| Hydrophilicity of nonwoven after aging | | | | | | | | |
| Initial hydrophilicity | | 20 | 20 | 20 | 20 | 20 | 20 | 20 |
| Durable hydrophilicity | 1st | 20 | 20 | 20 | 20 | 20 | 20 | 20 |
| | 2nd | 16 | 17 | 17 | 18 | 18 | 17 | 17 |
| | 3rd | 10 | 11 | 10 | 11 | 12 | 12 | 11 |
| | 4th | 4 | 3 | 5 | 4 | 2 | 7 | 5 |
| | 5th | 0 | 0 | 0 | 0 | 0 | 0 | 0 |

Ex.: Example

TABLE 4

| | | Comp. ex. 1 | Comp. ex. 2 | Comp. ex. 3 | Comp. ex. 4 | Comp. ex. 5 | Comp. ex. 6 | Comp. ex. 7 |
|---|---|---|---|---|---|---|---|---|
| Carding performance Wrap on cylinder | | 5 | 5 | 5 | 5 | 5 | 4 | 4 |
| Antistaticity | | 5 | 5 | 5 | 5 | 5 | 3 | 4 |
| Hydrophilicity of nonwoven | | | | | | | | |
| Initial hydrophilicity | | 20 | 20 | 20 | 20 | 20 | 20 | 20 |
| Durable hydrophilicity | 1st | 14 | 16 | 12 | 20 | 17 | 20 | 20 |
| | 2nd | 10 | 10 | 9 | 15 | 10 | 20 | 20 |
| | 3rd | 5 | 6 | 2 | 7 | 0 | 17 | 16 |
| | 4th | 0 | 0 | 0 | 0 | — | 9 | 10 |
| | 5th | — | — | — | — | — | 4 | 5 |
| Wet-back (g) | | 3.3 | 4.7 | 4.0 | 3.9 | 2.8 | 3.3 | 5.5 |
| Hydrophilicity of nonwoven after aging | | | | | | | | |
| Initial hydrophilicity | | 14 | 13 | 12 | 18 | 9 | 20 | 20 |
| Durable hydrophilicity | 1st | 8 | 6 | 8 | 10 | 3 | 20 | 20 |
| | 2nd | 1 | 0 | 0 | 4 | 0 | 16 | 17 |
| | 3rd | 0 | — | — | 0 | — | 12 | 11 |
| | 4th | — | — | — | — | — | 4 | 5 |
| | 5th | — | — | — | — | — | 0 | 0 |

Comp. e.: Comparative Example

The formula of the agent to be described in claim 1 and the Examples formulated within the scope of the formula exhibited a little wet-back and satisfied whole of the requirement including durable liquid permeability. Above all, the Examples 2 and 3 attained the least wet-back and most durable hydrophilicity of resultant nonwoven fabrics. The Comparative Examples formulated beyond the scope of the above formula could not satisfy all of the requirements. The Examples exhibited the synergism from the optimum combination of the components. The Comparative Examples resulted in more wet-back than each of the Examples.

The agent of the present invention decreases the wet-back of excreted liquid (urine, etc.) and contributes to improved durable hydrophilicity and minimized time-dependent reduction of hydrophilicity of fiber. In addition, the agent of the present invention imparts superior antistaticity to fiber that prevents fiber from static trouble at low humidity and imparts superior lubricity to fiber that improves the processability of the fiber in carding.

The application of the agent of the present invention, with spray or other application device, will attain sufficient hydrophilicity on hydrophobic fibers such as polypropylene fiber or hydrophobic nonwoven fabrics, decrease the wet-back of excreted liquid (urine, etc.) and minimize the time-dependent reduction of the durable hydrophilicity of nonwoven fabrics.

The agent of the present invention will attain special effect on fiber, i.e., improving the processing performance of fiber and the productivity in web formation in addition to attaining dry touch of fiber that is indispensable for nonwoven fabric transferring excreted liquid.

It is claimed:

1. A fiber treating agent for imparting liquid permeability comprising (a) 20 to 60 weight percent of alkyl phosphate salts, (b) 10 to 30 weight percent of a trialkylglycine derivative, (c) 5 to 20 weight percent of a polyoxyalkylene-modified silicone in which the content of silicon is 20 to 70 weight percent, and (d) 10 to 35 weight percent of an ester consisting of dicarboxylic acid and alkoxylated ricinolein and/or hydrogenated product thereof, in which at least one of the hydroxyl groups is esterified with saturated and/or unsaturated monocarboxylic acid.

2. Liquid-permeable fiber to which 0.1 to 2.0 weight percent of the fiber treating agent for imparting liquid permeability in claim 1 has been applied.

3. The fiber treating agent of claim 1 wherein component (a) comprises potassium alkyl phosphate having $C_{8-14}$ alkyl group, component (b) comprises a $C_{14-20}$ trialkylglycine hydroxide, component (c) comprises a polyoxyalkylene-modified silicone of which the polyoxyalkylene group contains 20 weight percent or more of polyoxyethylene and of which the molecular weight ranges from 1,000 to 100,000, and component (d) comprises an ester of dicarboxylic acid which is maleic acid and/or phthalic acid, and alkoxylated ricinolein which is an alkylene oxide adduct of hydroxystearic acid glyceride, the ester of which hydroxyl group is esterified with a $C_{10-22}$ monocarboxylic acid.

4. The liquid permeable fiber of claim 2 wherein component (a) comprises potassium alkyl phosphate having $C_{8-14}$ alkyl group, component (b) comprises a $C_{14-20}$ trialkylglycine hydroxide, component (C) comprises a polyoxyalkylene-modified silicone of which the polyoxyalkylene group contains 20 weight percent or more of polyoxyethylene and of which the molecular weight ranges from 1,000 to 100,000, and component (d) comprises an ester of dicarboxylic acid which is maleic acid and/or phthalic acid, and alkoxylated ricinolein which is an alkylene oxide adduct of hydroxystearic acid glyceride, the ester of which hydroxyl group is esterified with a $C_{10-22}$ monocarboxylic acid.

* * * * *